United States Patent [19]

Toro

[11] 3,951,314

[45] Apr. 20, 1976

[54] SPRAYING DEVICE WITH LIQUID-VAPOR WITHDRAWAL VALVE

[76] Inventor: Anthony S. Toro, 6834 SW. 15th St., Pembroke Pines, Fla. 33023

[22] Filed: Dec. 16, 1974

[21] Appl. No.: 532,751

[52] U.S. Cl. ..... 222/402.17; 222/402.18; 239/112

[51] Int. Cl.[2] ..... B65D 83/14

[58] Field of Search ..... 222/3, 4, 148, 396, 222/397, 402.17, 402.18; 239/112, 113

[56] References Cited

UNITED STATES PATENTS

| | | | |
|---|---|---|---|
| 2,605,848 | 8/1952 | Carter | 222/397 X |
| 3,357,601 | 12/1967 | Crawford et al. | 222/397 |
| 3,430,820 | 3/1969 | Winters et al. | 222/402.17 |
| 3,459,220 | 8/1969 | Morse | 222/4 X |
| 3,578,788 | 5/1971 | Potter et al. | 222/396 X |
| 3,658,208 | 4/1972 | Hansen | 222/396 X |

*Primary Examiner*—Stanley H. Tollberg
*Assistant Examiner*—Francis J. Bartuska

[57] ABSTRACT

A valve assembly for a pressurized container which is manually, selectively movable between a first position wherein a dispensing valve may be actuated to dispense various types of pressurized liquids from a container, and a second position wherein pressurized air or gas, normally stored above the liquid in the container, is passed through the dispensing valve to clear same of any obstructions or clogs which may form therein during usage or during storage periods.

10 Claims, 7 Drawing Figures

SPRAYING DEVICE WITH LIQUID-VAPOR WITHDRAWAL VALVE

BACKGROUND OF THE PRESENT INVENTION

Various types of pressurized containers have been in wide usage for many years for storing and dispensing liquids under pressure such as fuel gas, aerosol sprays, paint and various other liquids. One problem which frequently occurs with pressurized containers of this nature is that clogs or obstructions form in the dispensing valves, small orifices or passageways through which the liquid is dispensed by actuation of a lever, button or the like.

The dispensing means of the present invention provides a valve assembly, manually operable between a first position wherein a pressurized liquid in the container is discharged from a spray nozzle and a second position wherein the passage of liquid from the container to the spray nozzle is blocked and a passageway is opened from the head of a pressurized medium such as air or other gas above the liquid in the container to the spray nozzle in a manner so as to dislodge any clogs or obstructions therein without the discharge of any of the liquid from the container.

The pressurized container of the present invention is preferably of the type which is rechargeable with both the liquid to be dispensed and the medium such as compressed air or other gas used to dispense the liquid.

PRIOR ART

The most pertinent prior art known to applicant is U.S. Pat. Nos. 3,357,601 and 3,005,577, each of which shows a pressurized container for dispensing liquid having a safety valve. Neither of these references show the apparatus of the present invention and particularly do not show the arrangement by which the discharge orifice can be easily cleaned by use of a manually operated valve.

OBJECTS AND ADVANTAGES OF THE PRESENT INVENTION

One of the principal objects of the present invention is to provide a pressurized container for dispensing liquids which incorporates a manually operated valve means, selectively movable between a fluid dispensing position and a second position wherein the pressurized medium above the fluid is discharged through the discharge valve and nozzle as well as the associated orifices and passages. In the second position, no liquid is discharged from the container.

Another principal object of this invention is to provide a lever means, associated with a container hold handle, which is located for convenient manipulation by a finger or thumb of the user. The hold handle is located in a top peripheral position, diametrically opposite the discharge orifice.

Yet another object of the instant invention is to provide said valve means in the form of a segment, pivotally connected to the lever means, formed to open from a discharge tube to the spray orifice in the first position and, in the second position, to close the discharge tube relative to the spray orifice and to open between the pressurized medium and the spray orifice.

A further object of the present invention is to improve a container of the pressurized type which include means to permit recharging same with a new supply of liquid and pressurized medium such as air or other gas.

DETAILED DESCRIPTION OF THE INVENTION

Figures 1, 3:
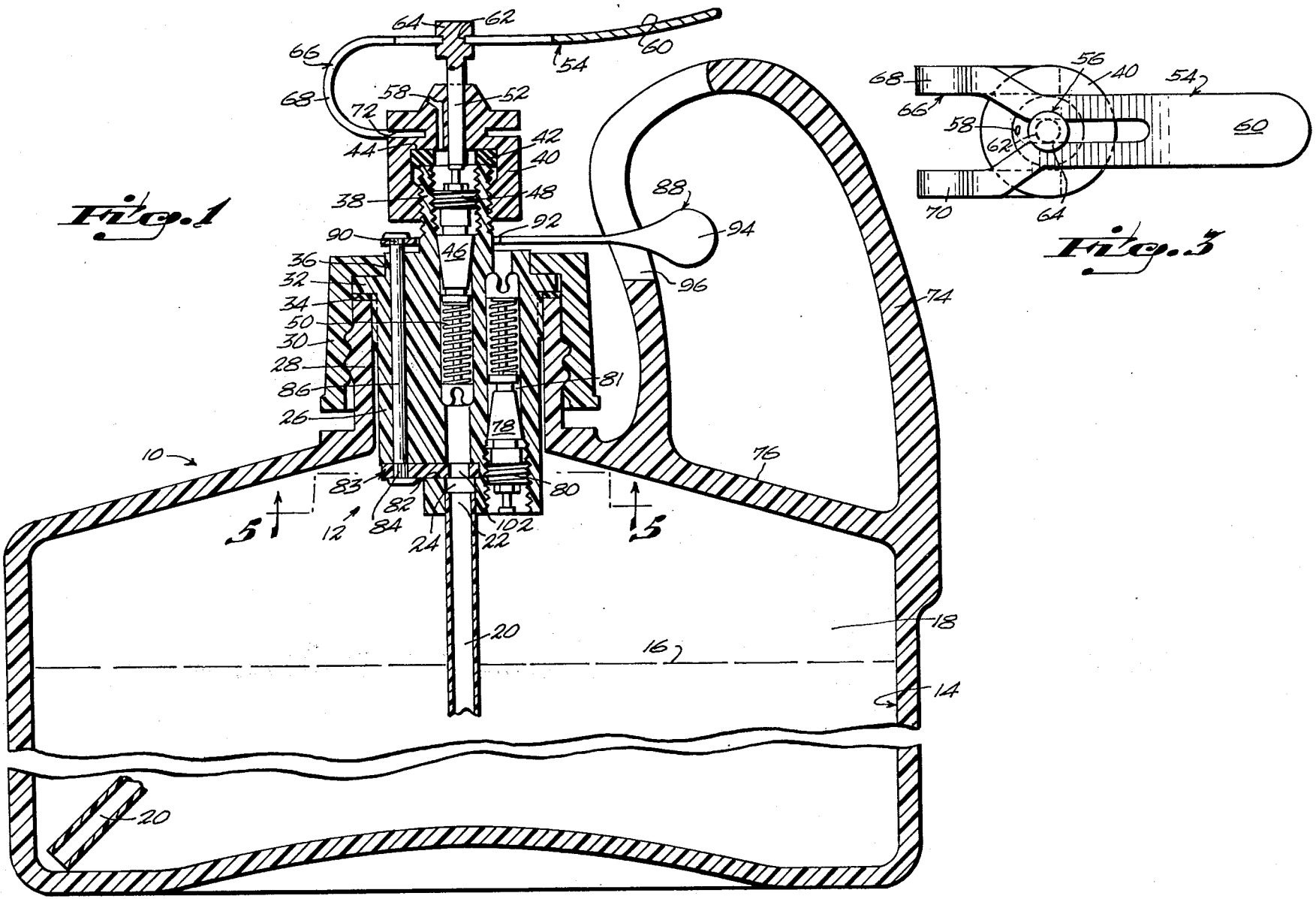
FIG. 1 is a fragmentary vertical cross sectional view of a pressurized container illustrating a first position of the valve assembly of the present invention.
FIG. 3 is a top plan view of the spray body and operating means.
Figure 2:
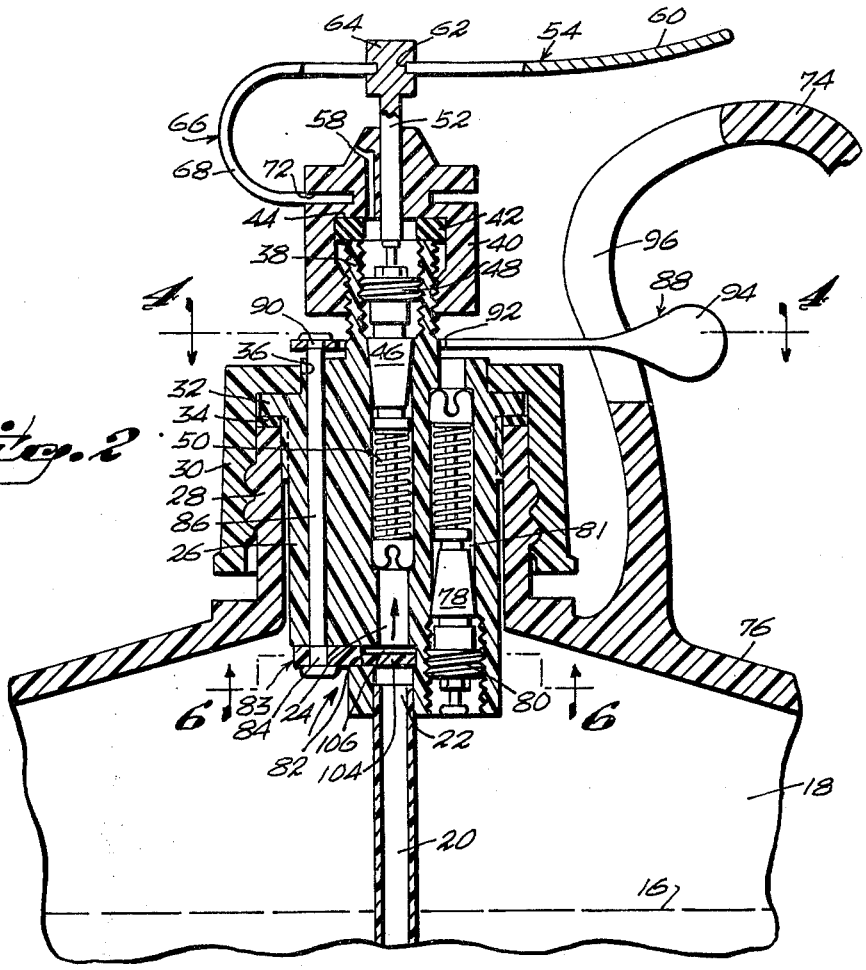
FIG. 2 is a fragmentary vertical cross sectional view similar to FIG. 1, illustrating a second position of the valve assembly.

With reference to the drawings in which like reference numerals designate like or corresponding parts throughout the various views and with particular reference to FIGS. 1 and 2, the numeral 10 generally, fragmentarily designates a pressurized container incorporating the valve assembly 12 of the present invention.

The container 10 provides an interior chamber 14 for the reception of a liquid to a level designated generally at 16. Above the liquid level 16, a pressurized head of a discharge medium such as compressed air or other appropriate gas is contained in the upper chamber portion 18. A discharge tube 20 extends upwardly from the bottom portion of the chamber 14 to a point of attachment at its upper end 22 within the lower end of a port 24 opening axially upwardly through a valve supporting stopper member 26. Securing the stopper member 26 within the exteriorly screw threaded neck 28 of the container 10 is an interiorly screw threaded cap 30. The cap 30 clamps an annular flange 32 of member 26 against the top edge of the neck 28 with a gasket 34 interposed therebetween.

Projecting upwardly through an annular hole 36 in the cap 30 is an exteriorly screw threaded, reduced diameter extension or nipple 38 of the stopper member 26 for reception of an interiorly screw threaded spray top 40. A gasket 42 is interposed between the top edge of the nipple 38 and the interior top wall 44 of the interiorly screw threaded spray top 40.

Valve means 46 is screw threaded at 48 into the axial port 24. This valve 46 may be of a conventional type, being normally spring biased at 50 to a closed condition. A plunger 52 extending axially downwardly through the spray top is manually depressable by a spring lever 54 connected as at 56 thereto to open the valve 46 against spring 50 to permit pressurized liquid to be sprayed or discharged from an orifice 58 communicating with the liquid in the container 10 by means of the port 24, valve 46 and discharge tube 20.

The spring lever 54 includes a finger engagement portion 60, the bifurcated connection portion 56 engaged in an annular slot 62 in a head portion 64 of the plunger 52 and a reversely downwardly bent spread apart bifurcated front portion 66. The two arms 68 and 70, comprising the front portion 66, are engaged in an annular slot 72 in the spray top 40. The finger engagement portion 60 is normally positioned adjacent to a handle grip 74, formed integrally with the top wall 76 of the container 10. In this manner, the handle 74 is gripped in one hand and the spring lever 54 may be actuated by one finger of the gripping hand to perform a spraying operation.

The pressure chamber 18 may be recharged by unscrewing the spray top 40 from the nipple 38, and by screwing thereon a recharging means such as a pump. A low pressure safety valve 78, screwed as at 80 upwardly into a vertically extending through port 81 in the stopper member 26 protects against overpressurizing the container 10 in a conventional manner. By removing the cap 30, the stopper member 26 may be removed to recharge the container 10 with an appropriate liquid.

Figure 4:
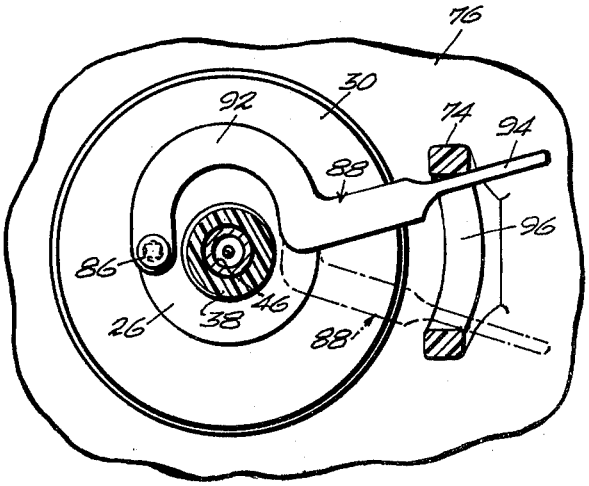
FIG. 4 is a cross sectional view taken along the line 4 — 4 of FIG. 2.

With particular reference to FIGS. 1, 2, 5 and 6, the valve supporting stopper member 26 is horizontally slotted at 82 through the port 24. A valve member 83 is pivotally connected in the slot 82 to the squared lower end 84 of a pivot pin 86 vertically journaled through the stopper member 26. As best illustrated in FIGS. 1, 2 and 4, a lever 88 is secured at its inner end to a squared upper end 90 of the pivot pin 86 outwardly of the stopper member. Lever 88 includes an arcuate inner portion 92 and an outer end 94 extending through an aperature 96 in the handle 74 into a position for manual manipulation thereof by a finger or thumb of the gripping hand. The arcuate portion 92 surrounds the nipple 38 in a manner so as to permit a predetermined degree of pivotal movement thereof to move the valve member 83 between first and second positions as will be subsequently described.

Figure 5:
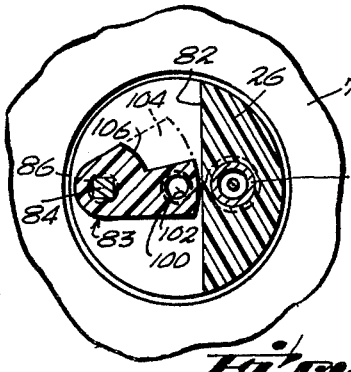
FIG. 5 is a cross sectional view taken along the line 5 — 5 of FIG. 1 illustrating a first position of the valve assembly of the instant invention.
Figure 7:
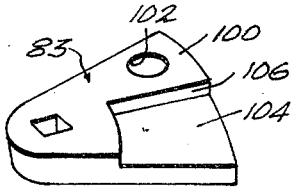
FIG. 7 is a perspective view of the valve body.
Figure 6:
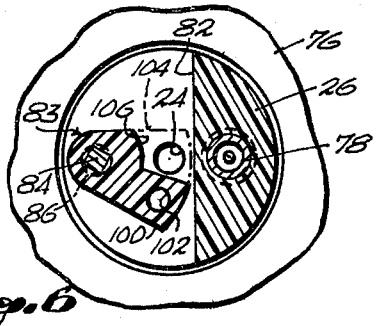
FIG. 6 is a cross sectional view similar to FIG. 5 taken along the line 6 — 6 of FIG. 2, illustrating the second position of the valve.

The valve member 83 is in the form of an arcuate segment having a thick side 100 with a hole 102 therethrough and a thin side 104 formed by a cut out portion 106 in the top thereof. With reference to FIGS. 1 and 5, when the lever 88 is in a first position, designated by the broken lines in FIG. 4, the thick side 100 of valve member 83 is positioned to align the discharge tube 20 with the port 24, liquid discharge valve 48 and spray orifice 58 through the segment valve hole 102. The thick side fills the slot 82 and seals off the pressurized upper chamber portion 18.

When the lever 88 is pivoted to the full line position of FIG. 4, the thin bottom side 104 seals the discharge tube 20 off from the upper portion of port 24 as best seen in FIG. 2. Simultaneously, the upper cut out portion 106 opens the upper pressure chamber portion 18 through slot 82, FIGS. 2 and 6, to the spray port 58 by means of the port 24 and the discharge valve 46. When the spring lever 54 is actuated, the pressurized medium such as air or other gas passes from the upper pressure chamber portion 18 through the slot 82, cut out valve portion 106, upper portion of port 24, discharge valve 46 and out through the spray orifice 58 to clear any obstructions or clogs therefrom. Briefly, when the lever 88 is in the first position, the fluid from the container 10 is discharged under pressure through the spray orifice 58, and when the lever 88 is in the second position, the pressurized medium from the upper chamber portion 18 is passed outwardly through the spray orifice 58 to clear the passageways and discharge valve of any clogs or obstructions formed during the spray operating or during a storage period.

What is claimed is:

1. A pressurized container assembly comprising,

A. a container defining an interior chamber to carry a liquid under a pressure head of a medium such as air or any other appropriate gas;

B. a top neck portion;

C. stopper means, removably fixed in said neck portion, providing a generally vertical port extending therethrough;

D. a reduced diameter discharge orifice in a spray top, fixed to said stopper, opening to the atmosphere from the top of said port;

E. discharge valve means removably fixed in said vertical port including an upwardly, axially extending actuating stem;

F. a discharge tube, extending downwardly into the liquid and having an upper end fixed relative to the lower end of said vertical port;

G. manual actuating means, connected to said spray top, to selectively engage said stem to open said discharge valve means;

H. a manually operable, pivotal valve segment bisecting said vertical port below said discharge valve and having a first portion providing a through hole communicating, in a first position, between the top end of said discharge tube and said discharge orifice by way of said discharge valve and vertical port; and a second portion in a sealing relation to the top of said discharge tube and providing an opening communicating between said pressurized head and discharge orifice in a second position;

I. a pivot pin extending vertically upwardly through said stopper in a spaced apart, parallel relation to said vertical port, said valve segment being fixed to the lower end thereof with a horizontally, outwardly extending, manually operable lever means being fixed to an upper extended end thereof to selectively position said valve segment in either of said first or second positions;

J. a handle grip extending upwardly from said container in a position closely adjacent to said valve segment lever means and said manual actuating means whereby said container may be selectively, instantaneously operated by a finger or thumb of the hand engaged with said handle to perform a liquid spraying operation or to deliver a short burst of the pressurized air through the nozzle.

2. The assembly, as defined in claim 1, wherein said valve segment is pivotally mounted in a horizontal slot in the lower portion of said stopper means.

3. The assembly, as defined in claim 2, wherein said second portion opening is provided by a top cut out communicating between said pressure head through said slot to said discharge orifice.

4. The assembly, as defined in claim 1, wherein said spray top is screw threaded onto an upwardly extending nipple portion of said stopper means, said discharge orifice extending through said spray top into communication with the upper end of said port.

5. The assembly, as defined in claim 4, wherein said manual actuating lever means comprises a spring lever, fixed between said spray top and a head portion of a plunger, slidably engaged vertically through said spray top into engagement with the top end of said actuating stem.

6. The assembly, as defined in claim 1, including a cap member in screw threaded engagement over said neck portion in a manner so as to captivate said stopper means within said neck.

7. The assembly, as defined in claim 6, wherein said stopper means includes an upper peripheral flange in an overlying relation to the top edge of said neck, said flange being clamped between said top edge and the underneath surface of the top of said cap member.

8. The assembly, as defined in claim 7, wherein said stopper means extends upwardly through an annular opening in the top of said cap member.

9. The assembly, as defined in claim 1, including a low pressure safety valve disposed between said pressure head and the atmosphere.

10. The assembly, as defined in claim 9, wherein said safety valve is removably fixed in a passageway extending upwardly through said stopper means.

* * * * *